United States Patent [19]

Yant et al.

[11] Patent Number: 4,740,212

[45] Date of Patent: Apr. 26, 1988

[54] PROCESS AND COMPOSITION FOR BLEACHING CELLULOSIC MATERIAL WITH HYPOCHLOROUS ACID

[75] Inventors: Robert E. Yant, Medina; Arthur L. Wolfe, Mentor; Marilyn M. Hurst, Hudson, all of Ohio

[73] Assignee: Quantum Technologies, Inc., Twinsburg, Ohio

[21] Appl. No.: 801,463

[22] Filed: Nov. 25, 1985

[51] Int. Cl.[4] ..... D21C 3/18; D21C 9/12

[52] U.S. Cl. ..... 8/108.1; 162/73; 162/76; 162/77; 162/87; 252/187.21; 252/187.32

[58] Field of Search ..... 8/108 A, 108 R; 162/72, 162/73, 87, 88, 76, 77; 252/187.21, 187.32

[56] References Cited

U.S. PATENT DOCUMENTS

| | | | |
|---|---|---|---|
| 2,174,534 | 10/1939 | Shipp | 8/118 |
| 2,178,696 | 11/1939 | Muskat et al. | 8/108 |
| 2,239,606 | 4/1941 | Hill et al. | 162/89 |
| 2,478,379 | 8/1949 | Dodson | 8/105 |
| 2,988,514 | 6/1961 | Robson et al. | 252/187 |
| 3,177,111 | 4/1965 | Larsen | 162/73 |
| 3,308,012 | 3/1967 | Tobar | 162/73 |
| 3,767,586 | 10/1973 | Rutkiewis | 252/187 |
| 4,096,029 | 6/1978 | Mills | 162/89 |
| 4,248,663 | 2/1981 | Kubes et al. | 162/72 |
| 4,295,928 | 10/1981 | Breslin | 162/72 |
| 4,298,428 | 11/1981 | Breslin et al. | 162/73 |
| 4,484,980 | 11/1984 | Allan | 162/73 |
| 4,487,656 | 12/1984 | Allan | 162/73 |
| 4,576,609 | 3/1986 | Hageman et al. | 8/103 |

FOREIGN PATENT DOCUMENTS 29802 3/1975 Japan .

191387 11/1982 Japan .

OTHER PUBLICATIONS

Burinskaya et al., "Effect of Sodium Dichloroisocyanurate Bleaching Solutions on Rayon Fiber"; *Chemical Abstrcts* #126470q, vol. 82, 1975.

Rapson et al., "The Reactions Between Chloride Dioxide and Pulp Constituents," *The Bleaching of Pulp*, Tappi Press 3rd ed, 1980, pp. 152–157.

Renard "Hypochlorite Bleaching" 1985 Tappi Seminar, Georgia p. 87.

*The Bleaching of Pulp*, Tappi Press, 3rd ed. (1980) pp. 25–28, 477–479.

Japanese Publication No. SHO58(1983)-186689.

Kolar, et al. *Chemical Reactions in Chlorine Dioxide Stages of Pulp Bleaching*, Wood Sci. Tech. 17:117 (1983).

Rapson, et al., *Kraft Pulp Bleaching with Chlorine and Chlorine Dioxide*, Tappi 61, No. 10, 97 (1978).

Robar, *Sulfamic Acid in the Chlorination and Hypochlorite Bleaching of Pulp*, Tappi 47, No. 11, 688 (1964).

*Primary Examiner*—Paul Lieberman

*Assistant Examiner*—Linda D. Skaling

*Attorney, Agent, or Firm*—Watts, Hoffmann, Fisher & Heinke

[57] ABSTRACT

A process and composition especially suited for bleaching wood pulp characterized by the use of hypochlorous acid in combination with chlorine dioxide and/or a nitrogen compound having the characteristic of minimizing fiber degradation and enhancing fiber brightness. The preferred composition is in an aqueous solution adjusted to an optimum pH and is used as a direct replacement for conventional compositions so as to effect substantial savings in the costs of chemicals and energy per ton of bleached pulp.

24 Claims, 3 Drawing Sheets

PROCESS AND COMPOSITION FOR BLEACHING CELLULOSIC MATERIAL WITH HYPOCHLOROUS ACID

TECHNICAL FIELD

The present invention relates generally to improvements in bleaching methods and compositions that are useful in purifying, de-coloring or similar processing of a wide variety of materials, and more specifically to provide methods and compositions that are effective to achieve acid bleaching of cellulosic materials, especially wood pulp and textiles, in an improved and efficient manner.

BACKGROUND ART

The bleaching of cellulosic materials such as wood pulp is carried out in a number of stages. In a typical process, an aqueous slurry of pulp is initially chlorinated with chlorine gas or chlorine water and is then subjected to caustic extraction using sodium hydroxide or the like. Following the chlorination (C) and caustic extraction (E) stages, the pulp is treated with any number of bleaching agents in a variety of sequences selected to achieve a desired brightness, while minimizing viscosity degradation or loss of strength of the pulp fiber. Some of the bleaching agents which have been proposed or used in the past include chlorine dioxide (D), sodium and calcium hypochlorite (H), hydrogen peroxide (P) and hypochlorous acid.

The use of chlorine dioxide is wide-spread, and it is employed in almost all modern pulp bleaching operations. It is also used in many pre-bleaching steps, such as in chlorination or delignification stages to minimize the loss of fiber strength or viscosity. Chlorine dioxide is usually prepared on-site in dilute aqueous solution by the reduction of sodium chlorate in a strong acid solution with a suitable reducing agent.

The process of producing sodium chlorate for the on-site generation of chlorine dioxide has a high energy requirement which makes chlorine dioxide expensive compared to other conventionally used bleaching agents. Because of its expense, every effort is made during use of chlorine dioxide to obtain maximum chemical efficiency. This includes maintaining the pulp slurry at a temperature from 65° to 75° C. for three hours or more in order to maximize the effectiveness of the chemical and achieve the desired brightness. Some bleaching applications require higher temperatures for as long as four hours.

The high operating temperature associated with the use of chlorine dioxide as a bleaching agent is a burdensome expense. Energy costs can vary from $2.00 to $8.00 per million B.T.U.s at the mill site resulting in a cost increase of $1.00 to $3.00 per ton for each 10° C. increase in operating temperature.

It has been theorized that hypochlorous acid is formed intermediately during bleaching of wood pulp with chlorine dioxide. In spite of this possibility, prior art attempts to use hypochlorous acid as a primary bleaching agent that is added to the pulp have been unsuccessful, and no commercial process based on hypochlorous acid stage bleaching is known to exist. U.S. Pat. No. 2,178,696 suggests that the irregular results obtained with hypochlorous acid are caused by "impurities", such as hydrogen chloride, salts of alkali or alkaline earth metals, chlorine dioxide, etc., and proposes the use of "pure" hypochlorous acid to overcome these difficulties.

The prior art has recognized that various additives can be used with the conventional bleaching agents for the purpose of maintaining high pulp viscosities while achieving the desired brightness. Typically, such additives are nitrogen containing compounds, such as sulfamic acid, amino acids, urea, and the like. As previously mentioned, it has also been recognized that chlorine dioxide is effective to protect pulp viscosity during the chlorination state of bleaching.

DISCLOSURE OF INVENTION

The present invention provides new and useful improvements in bleaching methods and compositions which are based on the use of hypochlorous acid. The hypochlorous acid is prepared in the absence of pulp and is added to the pulp slurry in combination with one or more materials, preferably chlorine dioxide and/or a nitrogen containing compound.

One important aspect of the invention is the discovery that a prepared bleaching addition of hypochlorous acid and chlorine dioxide makes it possible to reduce the operating temperature of the pulp bath up to 20° C. or more, e.g. from 75° C. to 55° C., while achieving the same high brightness obtained through the use of chlorine dioxide alone at the higher temperature. The manufacture of hypochlorous acid requires less energy than required for the production of an equivalent amount of chlorine dioxide, and therefore is significantly less expensive. Because of its lower cost and because of the reduction in bleaching temperatures that is made possible, the use of hypochlorous acid as a partial or full replacement for chlorine dioxide affords a significant reduction in chemical and energy costs per ton of bleached pulp.

The replacement of chlorine dioxide with hypochlorous acid has the further advantage of pollution abatement. The use of chlorine dioxide in the oxidative steps of wood pulp bleaching produces chlorites which are hazardous compounds. As more fully discussed below, the invention contemplates substituting hypochlorous acid in amounts ranging upward from about 5% by weight, and this materially reduces the chlorites produced as a result of the bleaching sequence.

It has also been discovered that a bleaching addition of hypochlorous acid prepared in the absence of pulp and added to the slurry in combination with a nitrogen containing compound, and with or without chlorine dioxide, is effective to achieve high levels of brightness as well as high pulp viscosities. The brightnesses and viscosities obtained through the practice of the invention are not produced by the use of hypochlorous acid as taught by the prior art.

In furtherance of the foregoing, the invention provides a method of bleaching cellulosic material comprising treating a bath of the material with an addition of hypochlorous acid prepared prior to being added to the bath and at least one additive selected from the class consisting of chlorine dioxide and nitrogen containing compounds having the characteristic of minimizing fiber degradation while enhancing brightness.

In more specific embodiments, the invention provides a method of bleaching a bath of cellulosic material such as wood pulp and the like comprising the steps of providing a solution of hypochlorous acid having a pH in a range of from 2 to 6 and more preferably from 3 to 5, adding the solution to the bath to provide an amount of hypochlorous acid available for bleaching which is at least 0.05% of the weight of the cellulosic material on a dry basis, adding at least one additive selected from the class consisting chlorine dioxide and nitrogen containing compounds effective to minimize a loss of fiber strength while enhancing fiber brightness, the amount of chlorine dioxide ranging from 0 to 95% of the combined weight of hypochlorous acid and chlorine dioxide with a minimum of about 5% by weight in the absence of nitrogen containing compound, the amount of nitrogen compound based on the weight of the hypochlorous acid charge ranging from 0 to about 150%, with a minimum of about 0.5% by weight in the absence of chlorine dioxide, and maintaining the bath of pulp at a temperature ranging from about 35° C. to 70° C. and more preferably from about 45° C. to 55° C. for a period of from about one-half to four hours. In carrying out the preferred process, the pH of the pulp bath is adjusted, if necessary, to obtain a final filtrate pH of 3.5 plus or minus 0.5 in order to achieve optimum brightness.

The invention also provides a bleaching composition comprising hypochlorous acid and at least one additive selected from the class consisting of chlorine dioxide and nitrogen containing compounds effective to minimize a loss of fiber strength while enhancing fiber brightness. In specific embodiments, the amount of chlorine dioxide ranges from 0 to about 95% of the combined weight of hypochlorous acid and chlorine dioxide with a minimum of about 5% by weight in the absence of nitrogen containing compound, the amount of nitrogen compound ranges from 0 to about 150% by weight based on the weight of hypochlorous acid with a minimum of about 0.5% by weight in the absence of chlorine dioxide, and the composition has a pH ranging from about 2 to 6 and more preferably from 3 to 5.

In especially preferred embodiments of the invention, the chlorine dioxide is present in a minimum amount of 5.0% by weight based on the combined weight of hypochlorous acid and chlorine dioxide, and the nitrogen containing compound is present in an amount of from 5% to 50% based on the weight of hypochlorous acid. Preferred nitrogen containing compounds which are effective to minimize loss of fiber strength while enhancing brightness are amides such as acetamide and the like; aminonitriles such as cyanamide, dicyandiamide and the like; esters such as ethyl glycine hydrochloride, t-butylglycine and the like; sulfonic acid and derivatives thereof such as sulfanilic acid, sulfamic acid, taurine, ammonium sulfamate and the like; amino acids such as glycine, cysteine, glutamic acid, lysine and the like; imides such as phthalimide, n-chlorosuccinimide and the like; hydantoins such as 5,5-dimethylhydantoin and the like; barbituric acid compounds such as uramil and the like; triazines such as melamine and the like; phosphatides such as lecithin and the like; cylic amines such as hexamethylenetetramine, caffeine and the like; amino alcohols such as 2-aminoethanol, 1-amino-2-propanol, 3-amino-1-propanol and the like; urea and urea derivatives such as biuret, dimethylolurea and the like; amidines such as guanidine hydrochloride, formamidine sulfuric acid and the like; and aromatic amines such as 0-aminophenol, 0-aminobenzoic acid and the like.

A critical aspect of the invention is that the hypochlorous acid be prepared before being added to the pulp bath. This critical feature makes it possible to control the pH and the compositional limits within the prescribed ranges, and in general makes the use of hypochlorous acid a practical reality. While hypochlorous acid may be generated in-situ, i.e. in the pulp bath, through the addition of conventional bleaching agents such as chlorine dioxide, it is not possible by such procedures to obtain the many advantages obtained through the practice of the present invention. For example, a process of generating hypochlorous acid in-situ, as by acidification of a hypochlorite stage, is difficult to control and has not been found to produce the consistent high brightness that is obtained with the process of the invention. In-situ processes of generating hypochlorous acid, as by additions of chlorine gas and chlorine dioxide, can produce hydrochloric acid which may adversely affect the efficiency of bleaching, as well as elemental chlorine which will attack the cellulose.

It is also essential that sufficient hypochlorous acid be added to the pulp bath to provide a critical minimum amount that is available for bleaching. In some multistage bleaching operations, the pulp may contain a prior stage carry-over of bleaching compound, such as hydrogen peroxide, etc. In these situations, the charge of hypochlorous acid should be increased to compensate for the amount that is reacted with the prior stage bleaching agent so the final charge of hypochlorous acid available for bleaching is at least 0.05% of the weight of the pulp on an oven dry basis.

The hypochlorous acid used in the processes and compositions of the invention is essentially free of hydrochloric acid and can be produced in the manner disclosed in U.S. Pat. No. 4,504,456, or by any number of procedures which are known in the art. The chlorine dioxide used in the processes and compositions also can be produced in conventional manner, as by on-site generators. Alternatively, hypochlorous acid can be reacted with sodium chlorite to form chlorine dioxide which is then introduced into the pulp slurry with excess hypochlorous acid.

The hypochlorous acid, chlorine dioxide and nitrogen compound can be in liquid or vapor form and added to the pulp in the same stage of bleaching either separately or as a prepared mixture. In the preferred process and composition, the hypochlorous acid is a dilute aqueous solution of from about 1 to 100 grams of hypochlorous acid per liter of water, preferably 1 to 50 grams per liter and still more preferably 1–10 grams per liter, and the chlorine dioxide and/or nitrogen compound are added to the solution to provide a conveniently usable prepared mixture. It is also preferred, although not essential to the practice of the invention, that the hypochlorous acid solution contain a halogen salt, such as sodium chloride or the like, in an amount ranging from 0 to 200% by weight based on the weight of hypochlorous acid with a preferred range of from about 5% to 200% and a most preferred range of from about 50% to 150%. It has been observed that the halide ion improves both brightness and viscosity of the pulp. The bleaching composition is customarily charged on the pulp in an amount of 0.05% to 5.0% by weight hypochlorous acid based on the weight of dry pulp.

That hypochlorous acid and chlorine dioxide can be combined in the same stage of bleaching, and more particularly that the two materials can be combined in a prepared mixture that is added to the raw material, is unexpected, since the equilibrium constant and the dynamics of the system indicate that chlorine dioxide would be oxidized to chlorate which is useless as a bleaching agent. This has not been found to happen, and one reason may be that a preferred reaction is between the hypochlorous acid and the lignin in the pulp.

When a mixture of hypochlorous acid and chlorine dioxide is prepared prior to addition to the pulp, it should be used as soon as possible, preferably within three hours or less, and no longer than about 24 hours, to minimize chlorate formation and obtain maximum bleaching efficiency. This assures that the bleaching addition will contain an adequate amount of available chlorine, i.e. at least 50% and more preferably 95% or more available chlorine.

A mixture of hypochlorous acid and chlorine dioxide prepared and used in the manner described above provides all of the advantages of conventional chlorine dioxide bleaching in regard to pulp quality with significant energy, capital and operating cost savings. The per pound cost of the combined bleaching agents is substantially less than chlorine dioxide alone, and the optimum pulp slurry operating temperature of 45° to 55° C. is 20° to 30° C. less than the bath operating temperature required for chlorine dioxide.

A mixture of hypochlorous acid and nitrogen compound also makes it possible to operate the pulp slurry at a reduced temperature at least 20° C. less than required for conventional bleaching with than chlorine dioxide and thereby achieves similar savings in operating and chemical expenses. At the same time, the mixture of hypochlorous acid and nitrogen containing compound has been found effective to achieve high levels of brightness and viscosity.

Other advantages and a fuller understanding of the invention will be had from the accompanying drawings and the following detailed description of preferred embodiments.

BEST MODE FOR CARRYING OUT THE INVENTION

Figure 1:
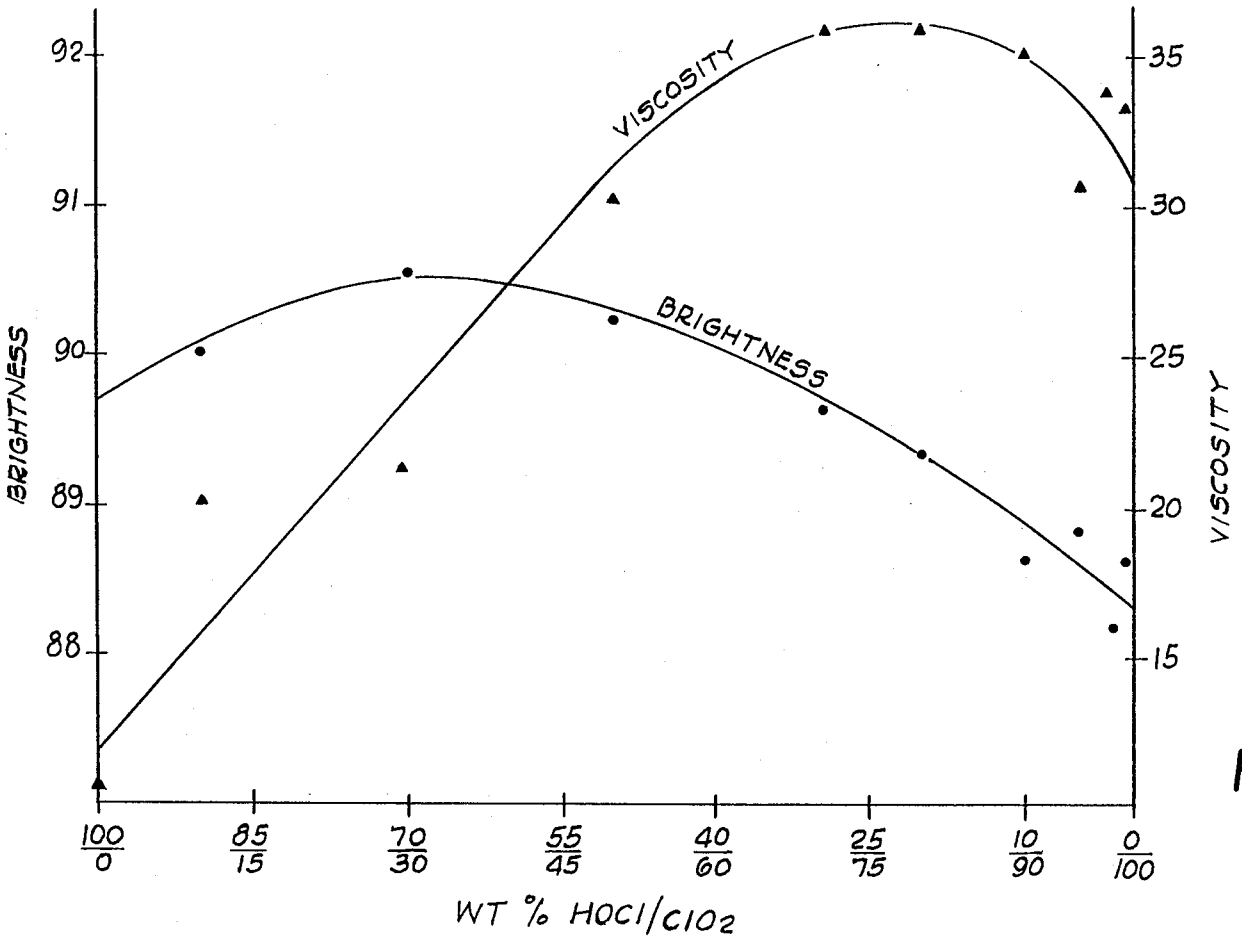
FIGS. 1, 2 and 3 are graphs showing brightness and viscosity plotted against bleaching compositions containing varying ratios of chlorine dioxide and hypochlorous acid.

In the following examples which illustrate preferred embodiments of the invention, a pulp is bleached with an aqueous solution of hypochlorous acid containing chlorine dioxide and/or a nitrogen containing compound selected to minimize viscosity degradation while enhancing brightness. In especially preferred examples, the new bleaching composition contains both chlorine dioxide and nitrogen compound with the former being present in a range of form about 5% to 95% of the combined weights chlorine dioxide and hypochlorous acid and the latter being present in a range of from about 5% to 20% based on the weight of hypochlorous acid. The preferred compositions additionally include a halogen salt, such as sodium chloride or the like, in an amount of from 5% to 200% based on the weight of hypochlorous acid.

The pH of the bleaching solution is adjusted to a range of from about 2 to 6, more preferably to 4.0 plus or minus 1.0, and it is then charged on the pulp as a replacement for conventional bleaching agents, including pure chlorine dioxide. The temperature of the pulp during the bleaching stage is maintained in a range of, from 35° C. to 70° C., more preferably from 45° C. to 55° C. for a period from one-half to four hours. Optimum brightness is achieved when the pH of the final filtrate is 3.5 plus or minus 0.5.

When used as a replacement for conventional D stage bleaching, the composition and process of the invention affords the unexpected advantage of producing at lower pulp temperatures the same brightness levels that are achieved with pure chlorine dioxide at substantially higher pulp temperatures. The ability to reduce the bleaching temperature while producing the same high brightness results in a significant savings in energy costs per ton of bleached pulp. In addition, the complete or partial replacements of chlorine dioxide or other bleaching agent by the composition of the invention reduces the cost of bleaching material per ton of pulp.

In each of the following examples of the invention, the pretreated pulp was washed to make it essentially free of prior stage chemical carry-over. The indicated amounts of hypochlorous acid charged on the pulp were available for bleaching and exceeded the critical minimum amount of 0.05% by weight of the dry pulp. Brightness was measured by standard GE brightness tests (TAPPI Standard T-217 m-48). Pulp viscosity values are given in centipoise and were determined according to TAPPI Standard T-230 om-82.

EXAMPLE 1

A solution of hypochlorous acid is prepared having a concentration of approximately 4.5 grams of hypochlorous acid per liter of water and a pH of 4.5 plus or minus 0.5. Separate quantities of the hypochlorous acid solution are then individually charged with various nitrogen compounds in amounts by weight of hypochlorous acid as set out in Table 1.

The solutions of hypochlorous acid and nitrogen compound and one sample containing no nitrogen compound are charged on a Northern softwood kraft pulp pretreated by a $D/CE_oD\ E_2$ sequence having an initial viscosity of 32.8 and brightness of 77.7. The solutions are charged in amounts of 0.15% and 0.60% by weight hypochlorous acid based on the weight of dry pulp. All samples are trreated for two hours at 50° C.

As will be seen from Table 1, the addition of the nitrogen compounds minimized degradation of pulp viscosity in comparison to the sample treated with hypochlorous acid alone. At the same time, treatment with most of the stabilized solutions enhanced brightness.

TABLE 1

| | Additive | Viscosity | | Brightness | |
|---|---|---|---|---|---|
| HOCl Charge On Pulp (%) | (%) | 0.15 | 0.60 | 0.15 | 0.60 |
| HOCl (no additive) | — | 22.5 | 8.6 | 88.89 | 90.43 |
| Ethyl Glycine Hydrochloride | 26 | 27.3 | 28.4 | 88.88 | 90.74 |
| Phthalimide | 27 | 28.3 | 21.8 | 88.80 | 90.79 |
| 2-Aminoethanol | 11 | — | 23.2 | — | 89.58 |
| L-Lysine | 27 | — | 25.5 | — | 88.94 |
| Sulfanilic Acid | 32 | 34.3 | 28.1 | 87.8 | 89.6 |
| Acetamide | 11 | 24.8 | 27.5 | 89.4 | 90.6 |
| Hexamethylene Tetramine | 7 | 32.2 | 25.4 | 89.3 | 90.7 |
| Dimethylolurea | 11 | 27.0 | 23.0 | 89.4 | 90.6 |
| Guanidine Hydrochloride | 6 | 29.2 | 22.0 | 89.7 | 90.6 |
| Formamidine Sulfinic Acid | 10 | 29.4 | 20.6 | 89.0 | 90.6 |
| N—Chlorosuccinimide | 25 | 26.6 | 20.3 | 89.1 | 90.4 |
| 5, 5-Dimethylhydantoin | 12 | 26.8 | 19.6 | 88.9 | 90.8 |

EXAMPLE 2

A hypochlorous acid solution is prepared in the manner described in Example 1 and charged with the nitrogen containing compounds in an amount by weight based on the weight of hypochlorous acid, as specified in Table 2.

The stabilized solutions and one sample containing no nitrogen compound are charged on a kraft hardwood pulp pretreated by a $CE_H$ sequence having an initial viscosity of 20.5 and a brightness of 69.4. All samples are charged in amounts of 0.15% and 0.60% by weight hypochlorous acid based on the weight of dry pulp, and the pulp is treated for two hours at 50° C. The viscosities and brightness values are listed in Table 2.

TABLE 2

| NOCl Charge On Pulp (%) | Additive (%) | Viscosity 0.15 | Viscosity 0.60 | Brightness 0.15 | Brightness 0.60 |
|---|---|---|---|---|---|
| HOCl (no additive) | — | 13.6 | 8.0 | 80.8 | 84.2 |
| 1-Amino-2-Propanol | 14 | — | 18.6 | 81.18 | 84.87 |
| Caffeine | 36 | — | 18.5 | 80.77 | 84.02 |
| L-Lysine | 27 | — | 18.3 | 80.61 | 83.96 |
| 2-Amino Ethanol | 11 | — | 18.3 | 81.36 | 84.91 |
| L-Cysteine | 23 | — | 18.2 | 79.57 | 83.35 |
| Lecithin | 145 | — | 17.4 | 79.73 | 84.22 |
| 3-Amino-1-Propanol | 14 | — | 17.1 | 80.91 | 84.68 |
| Biuret | 6 | — | 16.6 | 81.48 | 85.12 |
| o-Amino Phenol | 21 | — | 16.5 | 77.97 | 82.54 |
| Cyanamide | 4 | — | 16.2 | 80.97 | 83.48 |
| Taurine | 23 | — | 16.1 | 82.08 | 84.86 |
| o-Aminobenzoic Acid | 25 | — | 15.6 | 78.3 | 84.36 |
| Ammonium Sulfamate | 11 | — | 15.6 | 81.66 | 85.15 |
| Sulfamic Acid | 20 | — | 15.4 | 81.6 | 84.52 |
| Dicyandiamide | 4 | — | 15.3 | 81.1 | 85.6 |
| Glutamic acid | 27 | — | 15.1 | 80.6 | 85.0 |
| Glycine | 14 | — | 14.6 | 80.2 | 85.0 |
| Uramil | 9 | — | 14.5 | 81.8 | 84.0 |
| t-Butyl Glycine | 31 | — | 14.4 | 80.3 | 83.5 |
| Urea | 6 | — | 14.0 | 82.8 | 85.6 |
| Melamine | 8 | — | 12.7 | 80.5 | 83.7 |

EXAMPLE 3

Bleaching solutions are prepared containing hypochlorous acid and chlorine dioxide in varying relative proportions ranging from 100% HOCl and 0% $ClO_2$ to 100% $ClO_2$ and 0% HOCl. The solutions are charged on a softwood kraft pulp pretreated by a $D_cE_oD$ $E_2$ sequence in amounts of 0.4% by weight $HOCl/ClO_2$ based on the weight of dry pulp. The pulp is subjected to the bleaching solutions for three hours at a temperature of 45° C. The brightness and viscosity results are listed in Table 3 and plotted in the graph of FIG. 1.

It will be seen that partial substitution of hypochlorous acid for chlorine dioxide improved pulp brightness in all ratios in which the charge contains about 5% and more hypochlorous acid. It will also be seen that the viscosity of the pulp gradually improved with increasing amounts of chlorine dioxide.

TABLE 3

| % HOCl | BRIGHTNESS | VISCOSITY |
|---|---|---|
| 100 | 89.9 | 11.1 |
| 80 | 90.1 | 20.4 |
| 70 | 90.6 | 21.6 |
| 50 | 90.3 | 30.5 |
| 30 | 89.7 | 36.1 |
| 20 | 89.4 | 36.1 |
| 10 | 88.7 | 35.2 |
| 5 | 88.9 | 31.0 |
| 2 | 88.2 | 34.2 |
| 0 | 88.7 | 33.6 |

EXAMPLE 4

Figure 2:
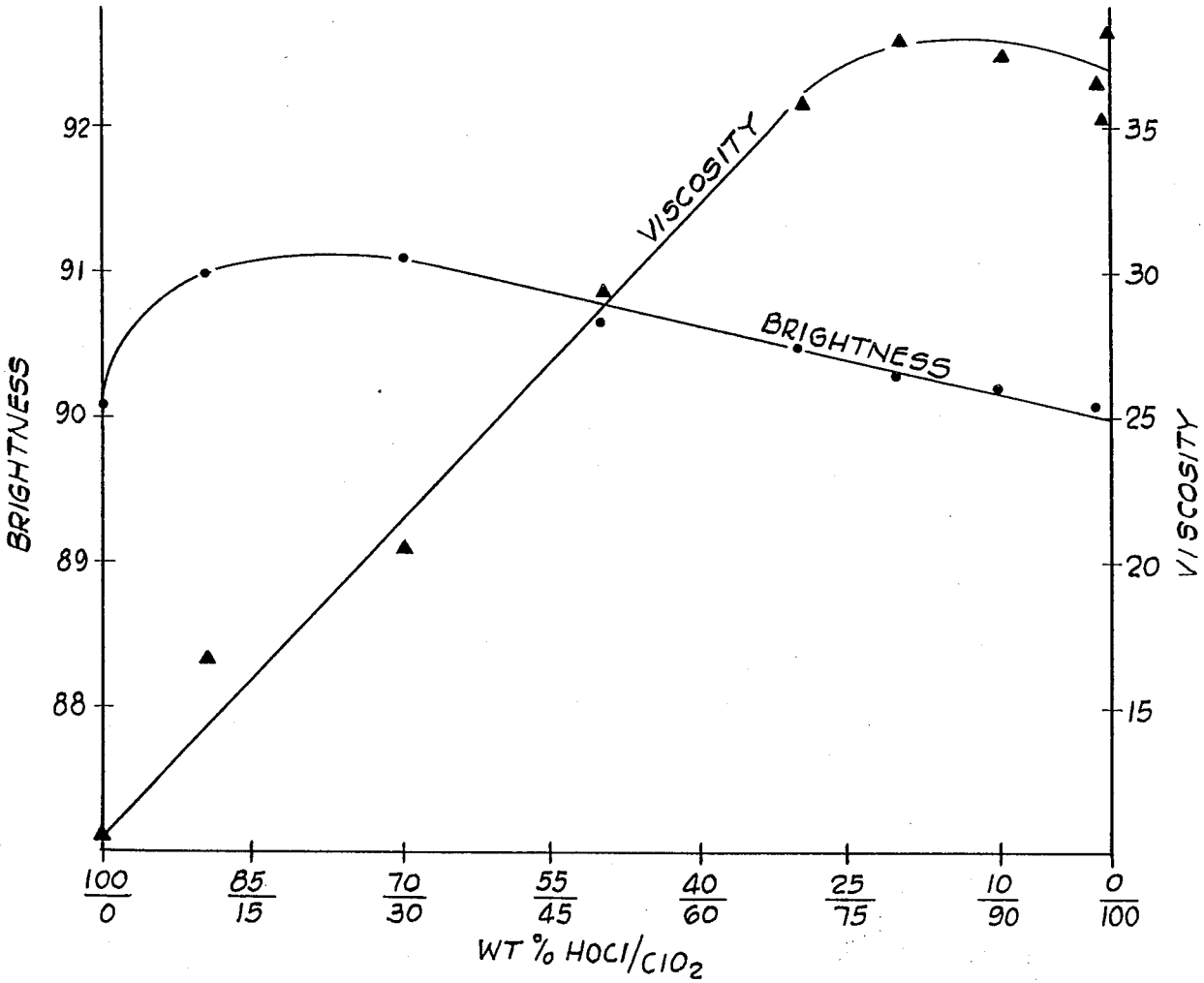

Bleaching solutions are prepared and charged on pulp, all as described in Example 3. The pulp is subjected to the bleaching additions for three hours at a temperature of 55° C. The brightness and viscosity results are listed in Table 4 and are shown in the graph of FIG. 2.

TABLE 4

| % HOCl | BRIGHTNESS | VISCOSITY |
|---|---|---|
| 100 | 90 | 10.5 |
| 80 | 91 | 16.6 |
| 70 | 91.1 | 20.4 |
| 50 | 90.6 | 29.3 |
| 30 | 90.5 | 35.9 |
| 20 | 90.3 | 38.0 |
| 10 | 90.2 | 37.5 |
| 5 | 90.3 | 36.3 |
| 2 | 90.0 | 35.3 |
| 0 | 90.1 | 38.7 |

EXAMPLE 5

Figure 3:
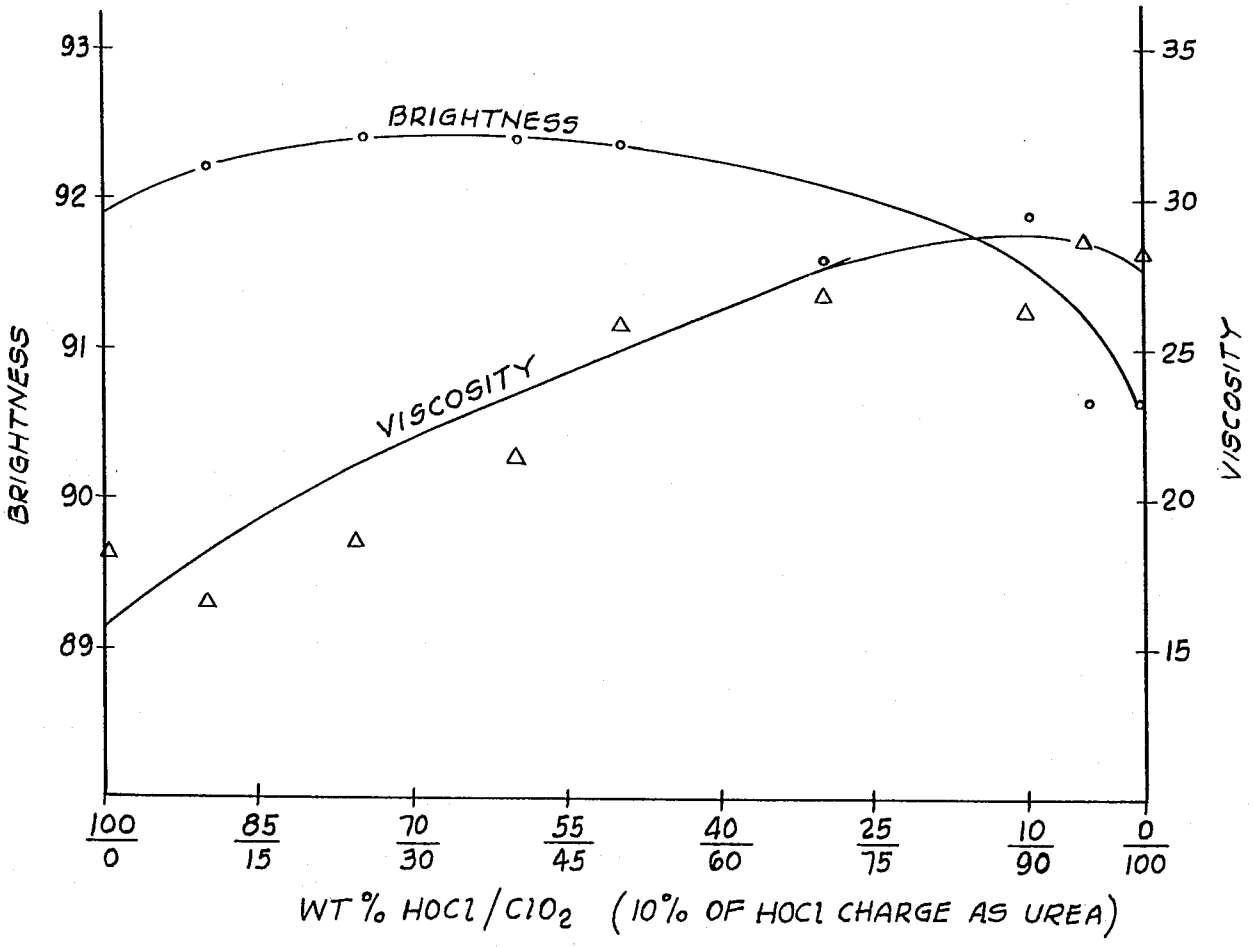

Bleaching solutions are prepared as described in Example 2 and are charged with 10% by weight urea based on the weight of hypochlorous acid. Softwood kraft pulp is treated with the solutions as described in Example 4. The brightness and viscosity results are listed in Table 5 and plotted in the graph of FIG. 3.

TABLE 5

| % HOCl | BRIGHTNESS | VISCOSITY |
|---|---|---|
| 100 | 91.9 | 18.2 |
| 90 | 92.2 | 16.3 |
| 75 | 92.4 | 18.2 |
| 60 | 92.3 | 22.8 |
| 50 | 92.2 | 25.9 |
| 30 | 91.6 | 26.7 |
| 10 | 91.9 | 26.4 |
| 5 | 90.5 | 28.7 |
| 0 | 90.6 | 28.3 |

When using a charge containing 100% chlorine dioxide, it was found necessary to operate the pulp bath at a temperature of 75° C. for three hours to obtain about the same brightness produced at the lower temperature of 55° C. with a charge containing 10% by weight HOCl and 90% by weight $ClO_2$.

EXAMPLE 6

A solution of hypochlorous acid is prepared and charged with sulfamic acid. The sulfamic acid is added in an amount of 10% by weight based on the weight of hypochlorous acid. The pH of the solution is maintained at 4.5 plus or minus 0.5.

The solution of hypochlorous acid is used both as a total and partial replacement for chlorine dioxide to bleach a kraft pulp previously treated by a $C_DEDE$ sequence. For comparison, the same kraft pulp is bleached in the fifth stage solely with chlorine dioxide. The brightness and viscosity and the details of the process are reported in Table 6.

TABLE 6

| | A | B | C |
|---|---|---|---|
| Pulping Process | Kraft | Kraft | Kraft |
| Pretreatment | $C_DEDE$ | $C_DEDE$ | $C_DEDE$ |
| % $ClO_2$ Charge on Pulp | 0.45 | — | 0.2 |
| % HOCl Charge on Pulp | — | 0.40 | 0.2 |
| Bath Temperature °C. | 75 | 55 | 55 |
| Time (hrs.) | 4 | 3 | 3 |
| Brightness | 91.7 | 92.1 | 91.8 |
| Viscosity | 28.8 | 18.2 | 25.9 |

As set out in Table 6, samples B and C which were respectively bleached entirely and partially with hypochlorous acid in the fifth stage were run for three hours at 55°, while sample A which was bleached entirely with chlorine dioxide in the fifth stage was run at 75° for four hours. It will be seen that the brightness results of all three samples are nearly identical. It is believed that the brightness of sample B which was treated entirely with hypochlorous acid in the fifth stage may result from the fact that the pulp was treated in the third stage with chlorine dioxide.

EXAMPLE 7

This example demonstrates the improved brightness results that are obtained when the hypochlorous acid is prepared prior to being added to the pulp slurry in comparison to a procedure in which the hypochlorous acid is produced in-situ in the presence of the pulp. Sample A in Table 7 is treated using hypochlorous acid prepared prior to being added to the pulp, while Sample B is treated by acidifying a sodium hypochlorite stage with chlorine gas to a pH of 3.5 in the presence of the pulp.

It will be seen that Sample A had a brightness of 88.2 compared to a brightness of 86.7 for Sample B. In addition to inferior brightness, the in-situ process will produce erratic results for the reason that the acidification of sodium hypochlorite or the alkalation of chlorine water in the presence of pulp is difficult to control.

TABLE 7

| | A | B |
|---|---|---|
| Pulping Process | Soda | Soda |
| Pretreatment | CEH | CEH |
| Charge on Pulp | 0.45% | 0.45% |
| Bleach Time | 4 hrs. | 4 hrs. |
| Bleach Temp. | 55° C. | 55° C. |
| Brightness | 88.2 | 86.7 |
| Viscosity | 6.4 | 6.4 |

EXAMPLE 8

A solution of hypochlorous acid is prepared according to Example 1 and is charged with 10% by weight urea based on the weight of hypochlorous acid. The solution of hypochlorous acid is used as a replacement for hydrogen peroxide in a CEHP bleaching sequence on kraft hardwood pulp as follows.

TABLE 8

| | | |
|---|---|---|
| Pulping Process | Kraft | Kraft |
| Pretreatment | CEH | CEH |
| % $H_2O_2$ Charge on Pulp | 0.45 | — |
| % NaOH Charge on Pulp | 1.0 | — |
| % HOCl Charge on Pulp | — | 0.45 |
| Temperature | 75° C. | 55° C. |
| Time (Minutes) | 90 | 90 |
| Filtrate pH | 9.29 | 4.0 |
| Brightness | 81.6 | 86.5 |
| Reversion (1 hr. at 105° C.) | 3.0 | 4.5 |
| Reverted Brightness | 78.6 | 82.0 |
| Viscosity | 13.6 | 12.5 |

It will be seen from the foregoing table that with the stabilized HOCl charge the brightness was improved while operating the pulp bath at a lower temperature of 55° C. compared to the brightness obtained using $H_2O_2$ at a temperature of 75° C. Assuming an energy cost of $2.50 per 1,000,000 B.T.U.s, it is estimated that the use of HOCl results in a savings in chemical and energy costs of approximately $7.00 per ton of bleached pulp.

EXAMPLE 9

A solution of hypochlorous acid is prepared in a manner similar to Example 8. The solution is used as a replacement for chlorine dioxide in the fourth stage of a CEHD bleaching sequence on soda hardwood pulp as follows:

| | | |
|---|---|---|
| Pulping Process | Soda | Soda |
| Pretreatment | CEH | CEH |
| % $ClO_2$ Charge on Pulp | 0.45 | — |
| % HOCl Charge on Pulp | — | 0.45 |
| Temperature | 75° C. | 50° C. |
| Time | 4 hrs. | 4 hrs. |
| Brightness | 88.2 | 88.1 |
| Viscosity | 7.5 | 6.1 |

It is estimated that the minimum savings in chemical and energy costs resulting from the use of HOCl is approximately $5.50 per ton of bleached pulp.

It will be apparent from the foregoing that the invention provides a new bleaching process and composition based on the use of hypochlorous acid which is prepared before being charged on the pulp and used as a full or partial replacement for conventional bleaching materials, especially chlorine dioxide. The process and composition of the invention has been shown to reduce chemical and energy costs per ton of bleached pulp.

Many modifications and variations of the invention will be evident to those skilled in the art in light of the foregoing disclosure. Therefore, it is to be understood that, within the scope of the appended claims, the invention can be practiced otherwise than as specifically shown and described.

We claim:

1. A method of bleaching cellulosic material comprising the steps of:

(a) charging an aqueous bath of said material with:

(i) hypochlorous acid to provide an amount available for bleaching which is at least 0.05% of the weight of said cellulosic material on a dry basis over and above that required to react with any prior stage bleaching agent contaminating said cellulosic material, said hypochlorous acid being prepared prior to its addition and added to said bath in a prepared solution having a pH of from about 3–5;

(ii) chlorine dioxide and nitrogen containing compound having the characteristic of minimizing fiber degradation, said chlorine dioxide being added to said bath in an amount effective for bleaching and ranging up to about 95% by weight based on the combined weight of hypochlorous acid and chlorine dioxide, and said nitrogen containing compound being added to said bath in an amount effective to inhibit fiber degradation and ranging up to about 150% by weight based on the weight of hypochlorous acid;

(b) operating said bath at a bleaching temperature of about 35° to about 70° C. for a time sufficient to attain a fiber brightness comparable to that obtainable in conventional bleaching methods only by operating at a higher temperature, and to attain a final filtrate pH of about 3 to about 4.

2. The process of claim 1 in which said prepared solution of hypochlorous acid is added to said aqueous bath separately from said chlorine dioxide and nitrogen containing compound.

3. The process of claim 1 in which said hypochlorous acid and said chlorine dioxide and nitrogen containing compound are combined in said prepared solution before being added to said bath.

4. The process of claim 1 wherein said nitrogen containing compound is selected from the group consisting of amides, aminonitriles, esters, sulfonic acid and derivatives, amino acids, imides, hydantoins, barbituric acid compounds, triazines, phosphatides, cylic amines, amino alcohols, urea and urea derivatives, amidines, and aromatic amines.

5. The process of claim 1 in which said chlorine dioxide is added to said bath in a minimum amount of 5% of the combined weight of hypochlorous acid and chlorine dioxide.

6. The process of claim 1 in which said nitrogen compound is added to said bath in a minimum amount of 5% based on the weight of hypochlorous acid.

7. The process of claim 1 in which said chlorine dioxide is added to said bath in a minimum amount of 5% of the combined weight of hypochlorous acid and chlorine dioxide, and said nitrogen compound is added in a minimum amount of 5% based on the weight of hypochlorous acid.

8. A method of bleaching cellulosic material comprising the steps of:

(a) charging an aqueous bath of said material with:

(i) a bleaching addition of hypochlorous acid and chlorine dioxide, said hypochlorous acid being added to provide an amount available for bleaching which is at least 0.05% of the weight of said cellulosic material on a dry basis over and above that required to react with any prior stage bleaching agent contaminating said cellulosic material, said hypochlorous acid being prepared prior to its addition and added to said bath in a prepared solution having a pH of from about 3 to 5 and a hypochlorous acid concentration of about 1 to about 50 grams per liter, said chlorine dioxide being added in an amount effective for bleaching and ranging up to about 95% by weight based on the combined weights of hypochlorous acid and chlorine dioxide;

(ii) nitrogen containing compound in an amount effective to inhibit fiber degradation and ranging up to about 150% by weight based on the weight of hypochlorous acid, said nitrogen containing compound having the characteristic of minimizing fiber degradation;

(iii) a chloride salt in an amount ranging from 0 to 200% by weight based on the weight of hypochlorous acid;

(b) operating said bath at a bleaching temperature of about 35° to about 70° C. so as to achieve superior levels of fiber brightness while avoiding severe fiber degradation.

9. A method of bleaching cellulosic material comprising the steps of:

(a) charging an aqueous bath of said material with:

(i) a bleaching addition of hypochlorous acid, chlorine dioxide and nitrogen containing compound capable of minimizing fiber degradation, said hypochlorous acid being added to provide an amount available for bleaching which is at least 0.05% of the weight of said cellulosic material on a dry basis over and above that required to react with any prior stage bleaching agent contaminating said cellulosic material, and hypochlorous acid being prepared prior to its addition and added to said bath in a prepared solution having a pH of from about 3 to 5, said chlorine dioxide being added in an amount from about 5% to about 95% by weight based on the combined weights of hypochlorous acid and chlorine dioxide; said nitrogen containing compound being added in an amount effective to inhibit fiber degradation and ranging up to about 50% by weight based on the weight of hypochlorous acid;

(ii) a chloride salt in an amount ranging from 0 to 200% by weight based on the weight of hypochlorous acid;

(b) operating said bath at a bleaching temperature between about 35° and about 70° C. to achieve a superior level of fiber brightness while avoiding severe fiber degradation.

10. A preformed aqueous bleaching solution suitable for addition to a slurry of pulp, said solution having a pH of from about 3 to about 5 and consisting essentially of hypochlorous acid in an amount of from 1 to 100 grams per liter of water, chlorine dioxide, and a nitrogen containing compound having the characteristic of minimizing degradation of cellulosic fiber without detracting from fiber brightness, said chlorine dioxide being present in an amount effective for bleaching and ranging up to about 95% by weight based on the combined weights of hypochlorous acid and chlorine dioxide, said nitrogen containing compound being present in an amount effective to inhibit fiber degradation and ranging up to about 150% by weight based on the weight of hypochlorous acid, and a chloride salt in an amount of from 0 to 200% by weight based on the weight of hypochlorous acid.

11. The bleaching solution of claim 10 in which said chlorine dioxide is present in a minimum amount of 5% by weight of the combined weight of hypochlorous acid and chlorine dioxide.

12. The bleaching solution of claim 10 or claim 11 in which said nitrogen compound is present in a minimum amount of 5% by weight based on the weight of hypochlorous acid.

13. A preformed aqueous bleaching solution suitable for addition to a slurry of pulp, said solution having a pH of from about 3 to 5 and solutes consisting essentially of hypochlorous acid in an amount of from about 1 to 50 grams per liter, chlorine dioxide in an amount from about 5% to about 95% by weight based on the combined weight of hypochlorous acid and chlorine dioxide, a nitrogen containing compound having the characteristic of minimizing fiber degradation in an amount of from about 5% to about 50% by weight based on the weight of hypochlorous acid, and a chloride salt in an amount of from 0 to 200% by weight based on the weight of hypochlorous acid.

14. The bleaching solution of claim 13 wherein the hypochlorous acid concentration is from about 1 to about 10 grams per liter.

15. The bleaching solution of claim 10, claim 13 or claim 14 wherein said nitrogen containing compound is selected from the group consisting of amides, aminonitriles, esters, sulfonic acid and derivitives, amino acids, imides, hydantoins, barbituric acid compounds, triazines, phosphatides, cylic amines, amino alcohols, urea and urea derivitives, amidines, and aromatic amines.

16. A method of bleaching fibrous cellulosic material comprising the steps of:

(a) charging a bath of said material with:

(i) a bleaching addition consisting essentially of hypochlorous acid and nitrogen containing compound having the characteristic of minimizing fiber degradation without detracting from fiber brightness, said hypochlorous acid being added to provide an amount available for bleaching which is at least 0.05% of the weight of said cellulosic material on a dry basis and being provided in an amount over and above that required to react with any prior stage bleaching agent contaminating said cellulosic material, said hypochlorous acid being added to said bath in a prepared aqueous solution having a pH of from about 3 to 5 and a hypochlorous acid concentration of about 1 to 50 grams per liter, said nitrogen compound being added in an amount effective to inhibit fiber degradation and ranging up to about 50% by weight based on the weight of hypochlorous acid; and (b) operating said bath at a bleaching temperature of about 35° to about 70° C. so as to achieve superior levels of fiber brightness while avoiding severe fiber degradation, and to attain a final filtrate pH of about 3 to about 4.

17. The process of claim 7 wherein said hypochlorous acid, chlorine dioxide and nitrogen compound are added to said bath in the form of a common solution.

18. The process of claim 17 wherein the maximum amount of said nitrogen compound is about 50% by weight of hypochlorous acid.

19. The process of claim 18 wherein the amount of hypochlorous acid is not more than about 5% of the weight of the cellulosic material on a dry basis and the amount of said nitrogen compound is no more than 20% by weight based on the weight of hypochlorous acid.

20. The bleaching solution of claim 14 wherein said nitrogen containing compound amounts to no more than about 20% by weight based on the weight of hypochlorous acid.

21. The process according to any one of claims 8, 9 or 16 in which the bath is operated to obtain filtrate pH of from about 3 to 4.

22. The method of claim 16 wherein said nitrogen compound is an amino alcohol.

23. A preformed aqueous bleaching solution suitable for addition to a slurry of pulp, said solution having a pH of from about 3 to about 5 and consisting essentially of hypochlorous acid and nitrogen containing compound, said hypochlorous acid being present in an amount of from about 1 to about 50 grams per liter, and said nitrogen compound being present in an amount of from about 1% to 50% by weight based on the weight of hypochlorous acid.

24. A bleaching solution is claimed in claim 23 wherein said nitrogen compound is an amino alcohol.

* * * * *